US005132516A

United States Patent [19]

Hatanaka et al.

[11] Patent Number: 5,132,516

[45] Date of Patent: Jul. 21, 1992

[54] GLOW PLUG HAVING SELF-TEMPERATURE CONTROL FUNCTION

[75] Inventors: Koji Hatanaka; Kazuhisa Iizasa, both of Saitama, Japan

[73] Assignee: Jidosha Kiki Co., Ltd., Tokyo, Japan

[21] Appl. No.: 579,553

[22] Filed: Sep. 10, 1990

[30] Foreign Application Priority Data

Sep. 11, 1989 [JP] Japan ..... 1-232743

[51] Int. Cl.[5] ..... H05B 1/02; H05B 3/18; F23Q 7/22; H01C 3/06

[52] U.S. Cl. ..... 219/270; 123/145 A; 219/541; 219/544; 219/553; 338/22 R

[58] Field of Search ..... 219/260-270, 219/541, 552, 553, 544, 504, 505; 123/145 A, 145 R; 338/22 R

[56] References Cited

U.S. PATENT DOCUMENTS 4,211,204 7/1980 Glaumer et al. ..... 123/145 A
4,423,309 12/1983 Murphy et al. ..... 219/270
4,549,071 10/1985 Hatamaka et al. ..... 219/270
4,636,614 1/1987 Itoh et al. ..... 219/270
4,733,053 3/1988 Mueller ..... 219/270

FOREIGN PATENT DOCUMENTS 62-194117 8/1987 Japan ..... 219/270
2198786 6/1988 United Kingdom ..... 219/270

*Primary Examiner*—Anthony Bartis
*Attorney, Agent, or Firm*—Blakely Sokoloff Taylor & Zafman

[57] ABSTRACT

A self temperature control type glow plug includes first and second resistor elements and a sheath. The sheath diameter of a first portion of the sheath in which the first resistor element is embedded is set to be smaller than the sheath diameter of a second portion of the sheath in which the second resistor element is embedded, wherein the ratio of the latter diameter of the former diameter ranges from 1.3:1 to 2:1. A tapered portion of the sheath joining the first and second sheath portions encloses a gap larger than at least the sheath diameter of the portion in which the first resistor element is embedded between the first and second resistor elements. The first and second resistor elements are connected to each other within the gap through a connecting means having a substantially zero resistance.

5 Claims, 5 Drawing Sheets

GLOW PLUG HAVING SELF-TEMPERATURE CONTROL FUNCTION

BACKGROUND OF THE INVENTION

The present invention relates to a glow plug as a preheat plug for improving the starting characteristics of a diesel engine and, more particularly, to an improvement in a self temperature control type glow plug having excellent fast heating and self temperature saturation properties and capable of achieving long-time afterglow.

Glow plugs having various structures have been known as glow plugs for improving the starting characteristics of a diesel engine. The applicant of the present invention has proposed a self temperature control type glow plug in Japanese Patent Laid-Open No. 57-182026. In this glow plug, a fast heating function and a temperature saturation function for preventing overheating of heating wires and obtaining stable heating characteristics are realized by an elaborate combination of resistor elements consisting of two types of materials.

More specifically, a glow plug of this type has a structure in which a first resistor element as a heating element and a second resistor element connected in series with the first resistor element and consisting of a material having a larger positive resistance-temperature coefficient than the first resistor element are embedded in a heat-resistant insulating powder in a metal sheath. In addition, a gap for delaying heat transfer from the first resistor element is set between the two resistor elements so as to ensure a fast heating property by supplying large power to the first resistor element immediately after energization to quickly cause it to generate heat. In addition, since the resistance of the second resistor element is increased with an increase in temperature thereof after the lapse of a predetermined period of time, the power supply to the first resistor element is reduced, thus performing the self temperature saturation function for preventing disconnection and the like upon fusing caused by overheating of the first resistor element. With such a structure, since a temperature control means or the like for controlling power to be supplied is not required to be arranged on an energization circuit for the glow plug, the cost of the overall preheat unit can be decreased.

In such a conventional glow plug, although a fast heating function and a self temperature saturation function can be ensured to a certain degree, it is difficult to obtain a heating property in which a heat temperature is decreased during afterglow after the start of an engine. That is, although the conventional glow plug can perform afterglow of about several tens seconds, a recent requirement of long-time (ten minutes or more) afterglow cannot be satisfied. In order to achieve the above-mentioned fast heating function and to perform a long-time afterglow operation while decreasing the heat temperature, a relay used during a heating period and a relay used during an afterglow period must be separately incorporated in the energization circuit for the glow plug, and a voltage-drop resistor or the like must be incorporated in the circuit on the afterglow side. This causes increases in the number of circuit components and the cost of the overall unit.

In order to achieve long-time afterglow by using only the glow plug without adding any element on the circuit, a self temperature control function is required. According to this function, energization power to the heating element is self-controlled to greatly improve the heating characteristics and prevent overheating at a heater portion. At the same time, in order to ensure durability of the heating wires, the saturation temperature is decreased below a proper temperature and is maintained at this temperature. A great demand has, therefore, arisen for a glow plug having a heater portion which has excellent fast heating and self temperature saturation properties and is highly reliable in terms of heat resistance.

In addition, other conventional glow plugs constituted by a combination of two types of heating wire as described above have been proposed in, e.g., Japanese Patent Laid-Open Nos. 54-60630 and 57-87535. In these glow plugs, in order to achieve a fast heating function, the diameter of a sheath front end portion in which a front end heating wire as a heating portion is embedded is set be small to have a smaller heat capacity than that of a portion in which a rear end heating wire constituting a control portion is embedded. In these conventional structures, the function for obtaining the first heating property can be achieved to a certain degree, in which large power is supplied to the front end heating wire in an initial energization period to obtain a predetermined heat temperature. However, the overshoot function for decreasing the heat temperature after the lapse of a predetermined period of time, and performing long-time afterglow while ensuring the durability of the heating wires cannot be satisfactorily achieved. That is, with the above-described structures, the conventional glow plugs cannot obtain the required characteristics that a heat temperature is temporarily increased to a required temperature, and the heat temperature is sufficiently decreased with the lapse of time to be saturated. Therefore, a measure for satisfying the above-described requirements in consideration of these points is required.

SUMMARY OF THE INVENTION

It is a principal object of the present invention to provide a self temperature control type glow plug having a fast heating function and long-time afterglow function.

It is another object of the present invention to provide a self temperature control type glow plug having excellent fast heating and self temperature saturation properties and the like and having excellent properties in terms of reliability.

In order to achieve the above objects, according to the present invention, there is provided a cell-temperature control type glow plug comprising a number of elements. The invention includes a first resistor element as a heating element, and a second resistor element that is connected in series to one end of the first resistor element and consists of a material having a larger positive resistance-temperature coefficient than the first resistor element. The first and second resistor elements are embedded in a heat-resistant insulating powder. The glow plug of the invention also includes a sheath for covering the first and second resistor elements, wherein a sheath diameter of a portion of the sheath in which the first resistor element is embedded is set to be smaller than a sheath diameter of a portion of the sheath in which the second resistor element is embedded. The invention also provides for a gap between the first and second resistor elements, said gap being larger than at least the sheath diameter of the portion in which the first resistor element is embedded. Moreover, the first and second resistor elements are connected to each other within the gap through connecting means having a small resistance.

According to the present invention, the heat capacity of the sheath front end portion in which the first resistor element as the heating element is embedded is set to be sufficiently smaller than that of the sheath rear end portion in which the second resistor element is embedded, thus obtaining a fast heating function. At the same time, a required power control function of the second resistor element as a control means embedded in the sheath rear end portion connected to the sheath front end portion, in which the heating element is embedded, through the predetermined gap is properly operated to obtain an overshoot property which allows long-time afterglow, i.e., a saturation property that saturation of a heat temperature is achieved at a temperature sufficiently lower than a peak temperature.

DETAILED DESCRIPTION OF THE PREFERRED EMBODIMENTS

An embodiment of the present invention will be described in detailed below with reference to the accompanying drawings.

Figure 1:
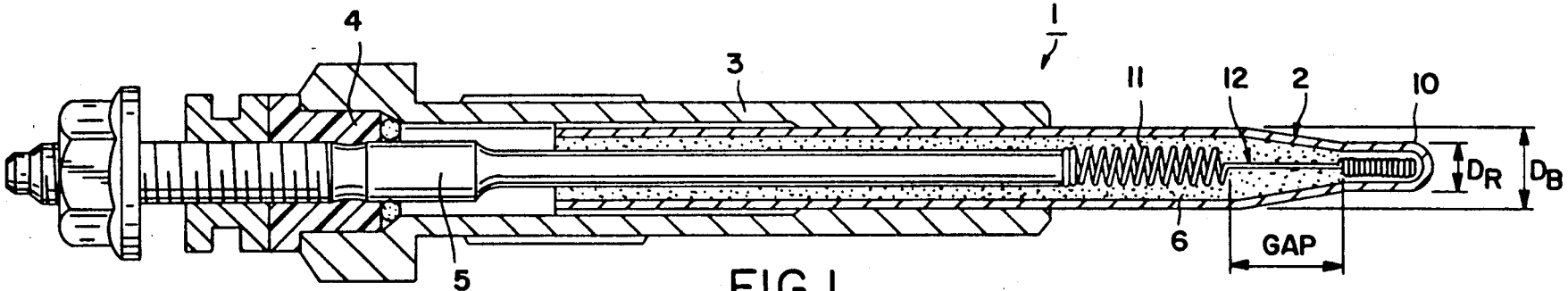
FIG. 1 is a sectional view showing a schematic arrangement of an overall self temperature control type glow plug according to the present invention.
Figure 2:
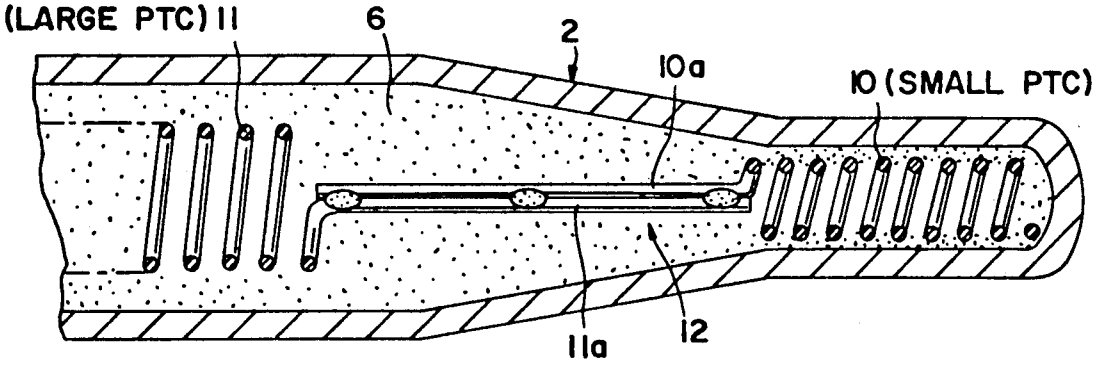
FIG. 2 is an enlarged sectional view showing a main part of the glow plug.

FIGS. 1 and 2 show a self temperature control type glow plug according to an embodiment of the present invention. A schematic arrangement of a glow plug denoted by reference numeral 1 in FIG. 1 and the like will be briefly described below with reference to FIGS. 1 and 2. Referring to FIGS. 1 and 2, reference numeral 2 denotes a sheath consisting of a heat-resistant metal material such as stainless steel; and 3, a cylindrical housing for holding the sheath at its front end portion. An electrode rod 5 is concentrically attached to the rear end portion of the housing 3 through an insulating bush 4. The front end of the electrode rod 5 is inserted in the sheath 1.

A first spiral resistor element 10 (to be referred to as a first resistor element hereinafter) as a heating element is arranged in the internal space of the front end portion of the sheath 2 along its axial direction. The first resistor element consists of a resistive material having a small positive resistance-temperature coefficient, e.g., an iron-chromium or nickel-chromium alloy. One end of the first resistor element 10 is electrically connected to the front end portion of the sheath 2. In addition, a second spiral resistor element 11 (to be referred to as a second resistor element hereinafter) is arranged in the internal space of the rear end portion of the sheath 2 between the first resistor element 10 and the electrode rod 5 so as to be continuous with the first resistor element 10. The second resistor element 11 consists of a resistive material having a large positive resistance-temperature coefficient, e.g., an iron-based material or nickel. With this arrangement, the first and second resistor elements 10 and 11 are connected in series with each other between the sheath 2 and the electrode rod 5. Note that the first and second resistor elements 10 and 11 are embedded in a heat-resistant insulating powder 6 such as magnesia (MgO) filled in the sheath 2.

The above-described second resistor element 11 serves not only as a heating source but also as a temperature control means. The second resistor element 11 as the temperature control means can supply large power immediately after the start of energization owing to the fact that it has a small resistance during this period. In addition, since the resistance of the second resistor element 11 is increased with the lapse of energization time, the supply power is reduced accordingly. As a result, the saturation temperature of the glow plug itself is suppressed below a predetermined temperature so as to prevent overheating. Such function can be clearly understood from the fact that the second resistor element 11 has the large positive resistance-temperature coefficient and its resistance is gradually increased with heating by energization. In order to perform proper current control by means of the second resistor element 11, the first and second resistor elements 10 and 11 are connected to each other such that their spiral portions oppose each other through a predetermined gap GAP. More specifically, the predetermined gap between the spiral portions ensures a time interval of thermal influences from the first resistor element 10 to the second resistor element 11. With this time interval, current control to be performed by the second resistor element is delayed so as to prolong the supply time of large power to the first resistor element 10, thus quickly red-heating the first resistor element 10 and greatly improving the temperature rising characteristics. In this embodiment, as is apparent from FIG. 2, linear end portions 10*a* and 11*a* axially extending from ends of the spiral portions of the first and second resistor elements 10 and 11 are caused to overlap each other in a parallel state and are connected to each other by laser welding or the like, thus constituting a connecting portion 12 having a small resistance (a value substantially close to zero).

According to the present invention, in the self temperature control type glow plug 1 having the above-described arrangement, a sheath diameter DR of the front end portion of the sheath 2 in which the first resistor element 10 as a heating element is embedded is set to be smaller than a sheath 2 in which the second resistor element 11 is embedded. In addition, the gap GAP larger than at least the sheath diameter DR of the sheath front end portion in which the first resistor element 10 is embedded (GAP > DR) is defined between the first and second resistor elements 10 and 11, and the resistor elements 10 and 11 are connected to each other within the gap through the connecting portion 12 designed to have a small resistance substantially close to zero, as described above. In the above-described embodiment, the sheath 2 portion corresponding to the above-mentioned gap is constituted by a bell-bottomed diameter-changing portion so as to couple the small-diameter front end portion to the large-diameter rear end portion.

Figure 3B:
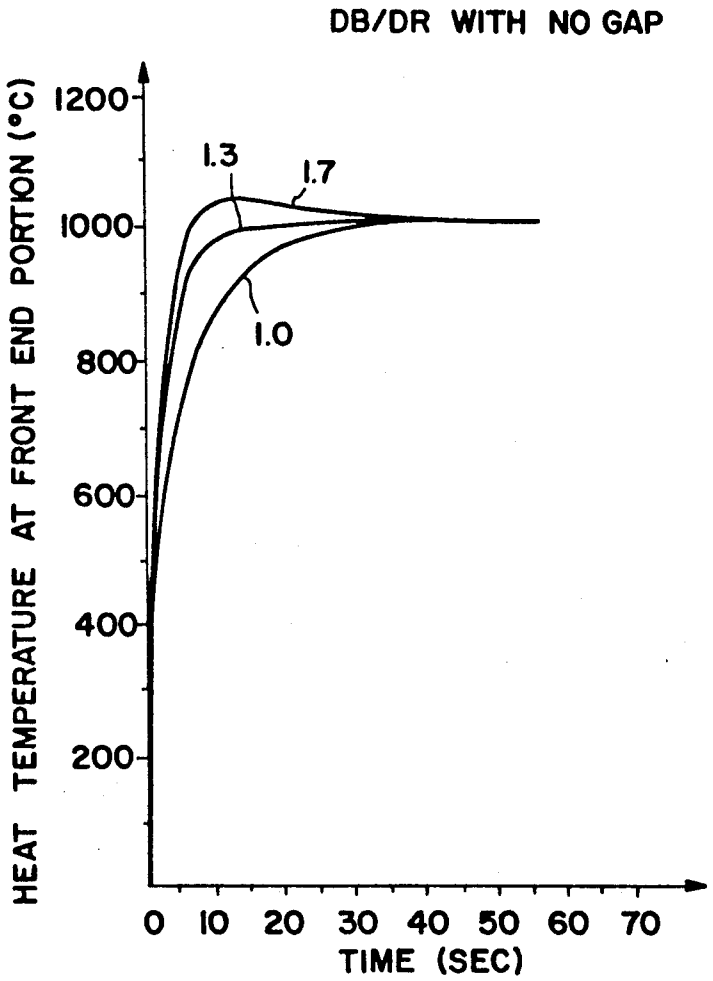
FIGS. 3A and 3B are graphs respectively showing changes in heat temperature of front end portions as a function of time with or without a gap.
Figure 3A:
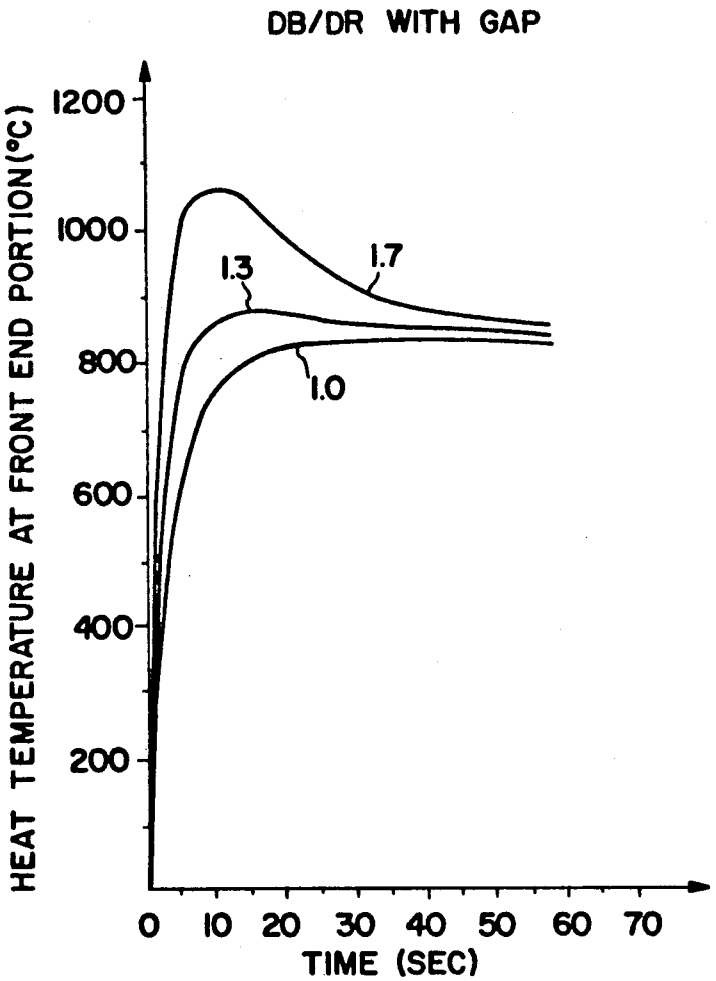

It is confirmed by experiments, as apparent from FIGS. 3(A) and (B), that the above-mentioned sheath diameters DR and DB are preferably set to satisfy DB $\geqq$1.3DR, and more preferably about (DB/DR =1.7). For example, if the sheath diameter DB of the rear portion of the sheath 2 is set to be 5$\phi$, the sheath diameter DR of the sheath front end portion is preferably set to be about 3100. Note that FIG. 3A shows characteristics obtained when the gap GAP is 8 mm and DB/DR =1.0, 1.3, and 1.7. It is confirmed that an overshoot characteristic is obtained with DB/DR =1.3 or more, and an optimal result is obtained with DB/DR =1.7 because of peak temperatures and sheath diameters associated with limitations on manufacturing. It is apparent that the fast heating property can be further improved by increasing the ratio. However, such an increase in ratio will excessively reduce the diameter of the sheath front end and poses problems in terms of manufacturing. That is, the sheath diameter DR of the front end portion has a limitation in manufacturing which is defined by a ratio of about 2.0 in consideration of the required thickness of the sheath 2 and the wire diameter of the spiral resistor element 10. FIG. 3B shows a characteristic obtained when no gap is set between the first and second resistor elements 10 and 11. It is apparent from FIG. 3B that a slight overshoot characteristic can be obtained with a ratio of about 1.7. However, the obtained characteristic is not sufficient in practice, and hence the necessity of the gap GAP in the present invention can be understood. That is, since the heat transfer between the resistor elements 10 and 11 is large, predetermined power control can be properly performed by simply changing the sheath diameter DR to reduce the heat capacity.

Figure 4:
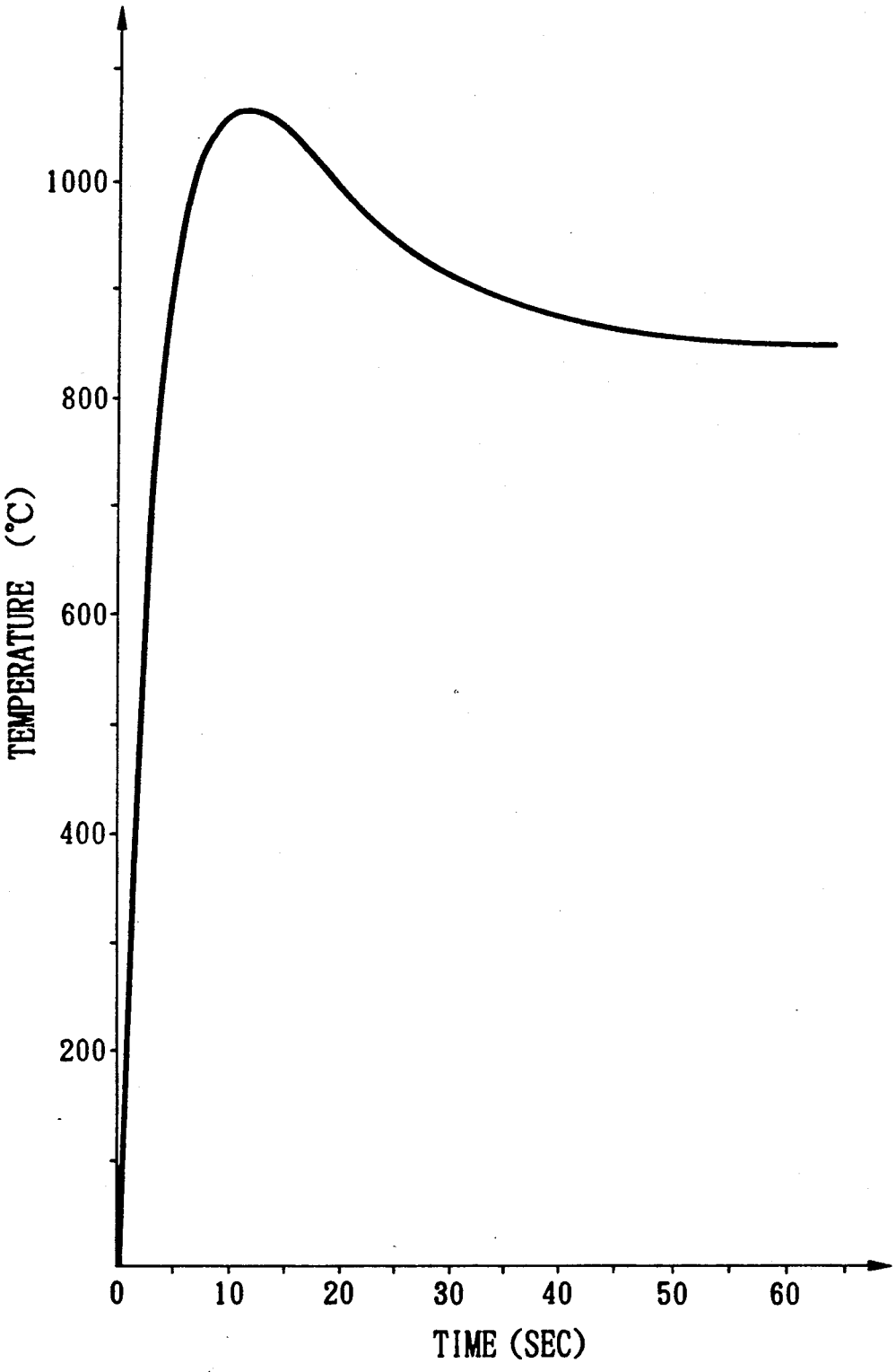
FIG. 4 is a graph for explaining heating properties.

According to the above-described arrangement, the heat capacity of the front end portion of the sheath 2 in which the first resistor element 10 as a heating element is embedded is set to be sufficiently smaller than that of the rear end portion of the sheath 2 in which the second resistor element 11 as a control means. With this setting, red heating can be quickly realized to allow the glow plug to exhibit the fast heating function, i.e., 800° C. is achieved within five seconds. In addition, this setting allows the second resistor element 11 as the control means, which is embedded in the rear portion of the sheath 2 and is connected to the first resistor element 10 in the front end portion of the sheath 2 through the predetermined gap, to properly perform the required power control function so as to obtain an overshoot characteristic shown in FIG. 4 in which a heat temperature after the start of an engine becomes saturated at about 850° C. which is sufficiently lower than a peak temperature of about 1,050° C. by about 200° C. This allows afterglow over a long period of time.

In addition, according to the present invention, since the above-described heating properties can be obtained by the self control of only the glow plug 1, a conventional relay for afterglow, a voltage-drop resistor, and the like can be omitted as unnecessary circuit components. This enables a reduction in cost of the overall preheat unit.

Figure 5A:
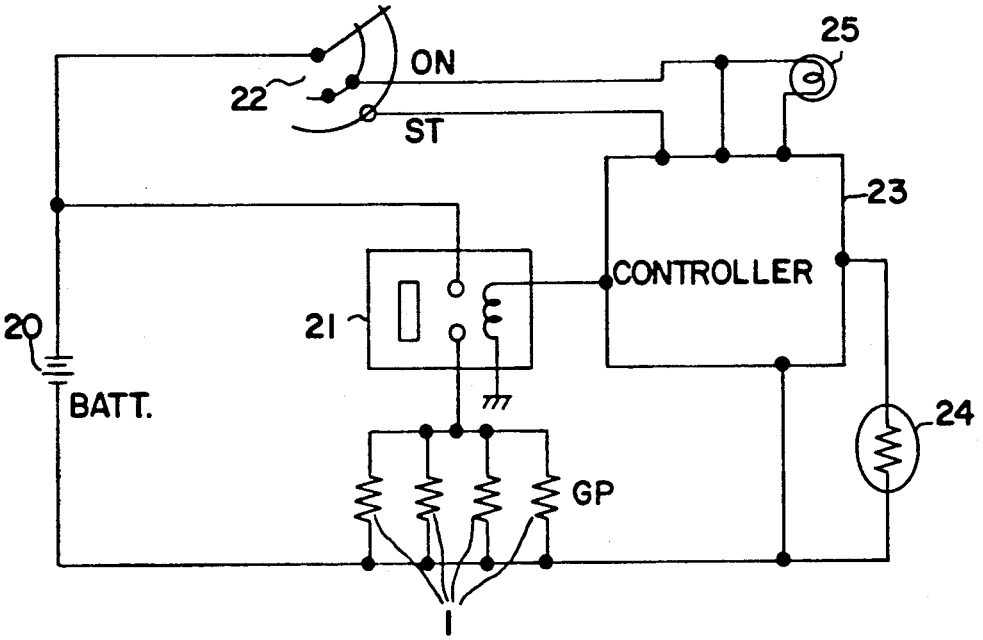
FIGS. 5A and 5B are circuit diagrams respectively showing arrangements of energization circuits for glow plugs according to the present invention and a prior art.

An energization control circuit for the above-described glow plug 1 will be briefly described below with reference to FIG. 5A. Four heater portions of the glow plug 1 (GP) are connected in parallel. A rated voltage of, e.g., 12 V from a battery source 20 is applied to each heater portion through a relay 21 to cause each heater portion to generate heat so as to preheat the combustion chamber or a subcombustion chamber of a diesel engine, thus helping the starting properties of the engine. Note that the glow plug 1 serves as a body earth. Referring to FIG. 5(A), reference 22 denotes an engine key switch; 23, a controller having a timer function; 24, an engine cooling water temperature sensor; and 25, a start timing display unit. The operations and the like of these components are known, and a detailed description thereof will be omitted.

Figure 5B:
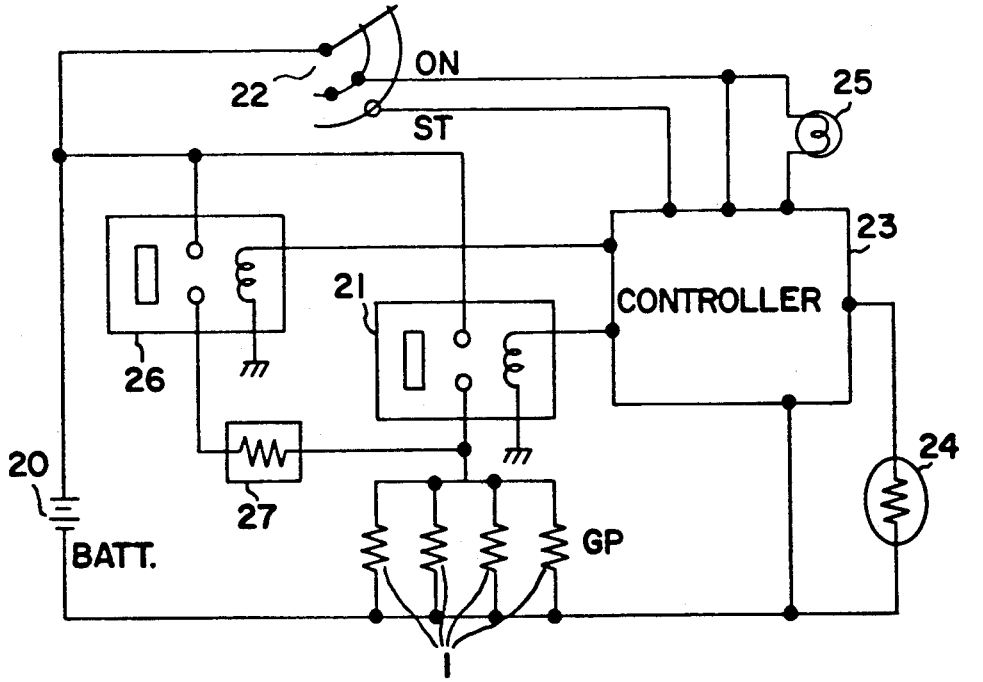
FIG.5B PRIOR ART

According to the glow plug 1 of the present invention, the above-described circuit arrangement can be employed because of its self temperature control function. In a conventional type of glow plug, however, as shown in FIG. 5B, another control circuit for afterglow is required in addition to a control relay 26 and a voltage-drop resistor 27 for the control circuit. Therefore, the difference in circuit arrangement between the glow plug of the present invention and the conventional glow plug can be easily understood.

Figure 6:
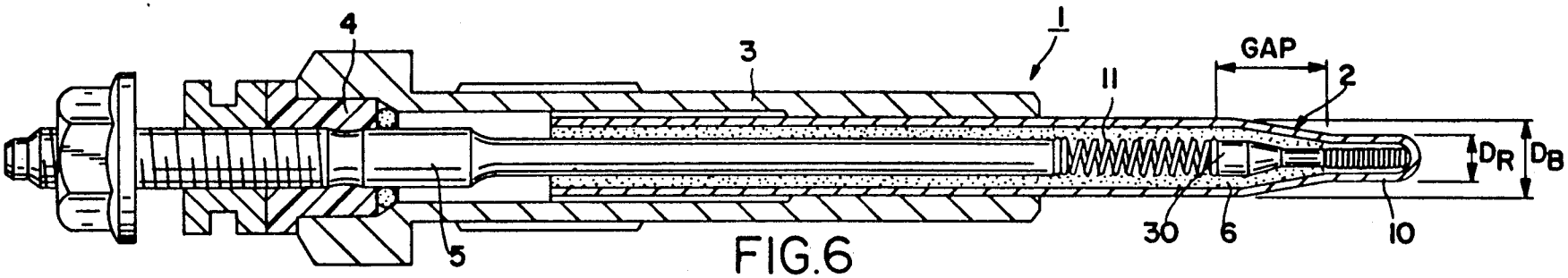
FIGS. 6 and 7 are a sectional view showing a schematic arrangement of an overall glow plug according to another embodiment of the present invention and an enlarged sectional view of a main part thereof.
Figure 7:
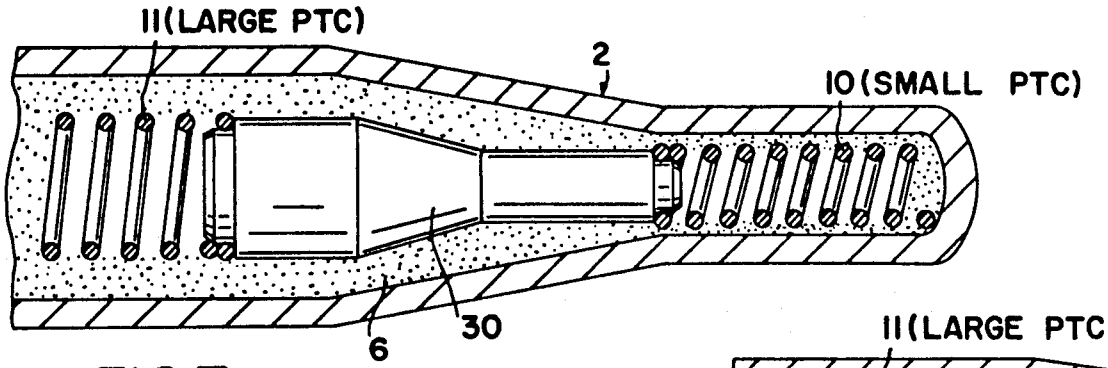
Figure 8:
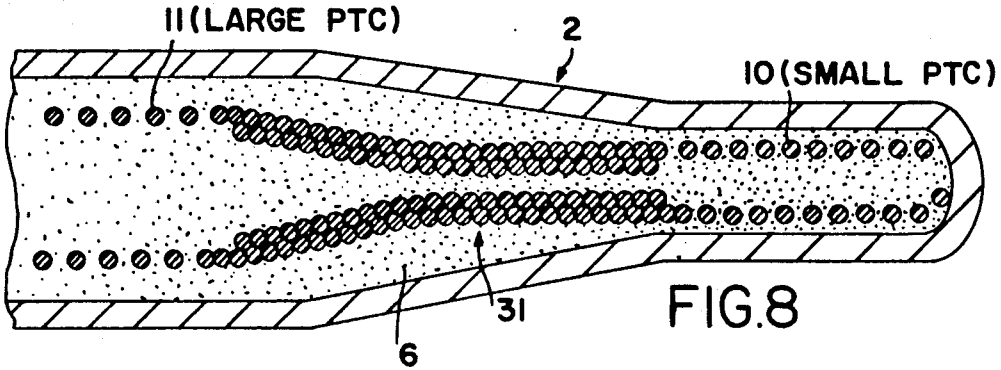
FIG 8 is an enlarged sectional view showing still another embodiment of the present invention.

The present invention is not limited to the above-described structure of the embodiment. The shape and structure of each component of the glow plug 1 can be arbitrarily modified and changed. In addition, a glow plug structure to which the present invention is applied is not limited to those shown in FIGS. 1 and 2. For example, as shown in FIGS. 6 and 7, a columnar or cylindrical rod member 30 having sectional areas larger than those of the first and second resistor elements 10 and 11 may be used to connect the two resistor elements to each other within the gap GAP. The resistance of the rod member 30 having such large sectional areas can be set to be substantially zero. In addition, as shown in FIG. 8, it is apparent that a connecting means such as a connecting portion 31 can be used, which is obtained by extending the spiral portions of the resistor elements 10 and 11 to form small-diameter spiral portions and twisting/bonding them together. That is, the two resistor elements 10 and 11 are to be connected to each other by a connecting means having a sufficiently small resistance through a predetermined gap.

As has been described above, the self temperature control type glow plug according to the present invention comprises a first resistor element as a heating element, a second resistor element connected in series with one end of the first resistor element and consisting of a material having a larger positive resistance-temperature coefficient than the first resistor element, and a sheath for covering the first and second resistor elements which they are embedded in a heat-resistant insulating powder. The sheath diameter of the sheath front end portion in which the first resistor element is embedded is set to be smaller than that of the sheath rear end portion in which the second resistor element is embedded. In addition, a gap larger than at least the sheath diameter of the sheath front end portion in which the first resistor element is embedded is set between the first and second resistor elements, and the two resistor elements are connected to each other within this gap through a connecting means having a small resistance. Therefore, the following effects can be obtained in spite of the simple arrangement. By sufficiently reducing the heat capacity of the sheath front end portion in which the first resistor element as a heating element is embedded, heat can be quickly generated during an initial energization period, and hence a fast heating function can be realized. In addition, a required power control function can be properly operated by means of the second resistor element as a control means on the sheath rear end side which is connected to the first resistor element on the sheath front end side through a predetermined gap, thereby obtaining an overshoot characteristic in which a heat temperature is obtained as a saturation temperature sufficiently lower than a peak temperature with the lapse of time. That is, long-time afterglow can be realized, and such heating characteristics can be obtained by the glow plug itself. Therefore, unnecessary circuit components can be omitted, and the cost of the overall preheat unit can be decreased.

What is claimed is:

1. A self temperature control type glow plug comprising a first resistor element as a heating element, a second resistor element connected in an end-to-end spaced relationship in series with one end of said first resistor element and consisting of a material having a larger positive resistance-temperature coefficient than said first resistor element, and an elongated generally cylindrical sheath covering said first and second resistor elements with said first and second resistor elements embedded in a heat-resistant insulating powder, wherein said elongated generally cylindrical sheath has a first portion in which is embedded said first resistor element, a second portion in which is embedded said second resistor element, and a tapered portion provided between said first and second portions, said tapered portion enclosing a gap between said first and second resistor elements, wherein a ratio of a diameter of said second portion to a diameter of said first portion has a range from 1.3:1 to 2:1, and wherein said gap is larger than said diameter of said first portion, and said first and second resistor elements are connected to each other within the gap through connecting means having a substantially zero resistance.

2. A glow plug according to claim 1, wherein said connecting means is constituted by welding linear portions each extending from one end of each of said first and second resistor elements while the linear portions overlap each other such that said connecting means has a substantially zero resistance.

3. A glow plug according to claim 1, wherein said connecting means is constituted by an electrically conductive member having larger sectional areas than said first and second resistor elements.

4. A glow plug according to claim 1, wherein said connecting means is constituted by twisting and bonding a pair of overlapping spiral portions each extending from one end of each of said first and second resistor elements.

5. A glow plug according to claim 4, wherein first and second resistor elements are formed into spiral elements, and the twisted and bonded portions are formed by twisting and bonding small-diameter spiral portions from an end of said first and second resistor elements.

* * * * *

UNITED STATES PATENT AND TRADEMARK OFFICE

CERTIFICATE OF CORRECTION

PATENT NO. : 5,132,516

DATED : July 21, 1992

INVENTOR(S) : Hatanaka et al.

It is certified that error appears in the above-identified patent and that said Letters Patent is hereby corrected as shown below:

In

[54] Abstract, at the seventh line replace "latter diameter of the former" with --latter diameter to the former--;

In column 4 at line 56 between "smaller than a sheath" and "2 in which the second resistor" insert --diameter DB of the rear end portion of the sheath--

Signed and Sealed this

Twelfth Day of September, 1995

*Attest:*

Bruce Lehman

BRUCE LEHMAN

*Attesting Officer*

*Commissioner of Patents and Trademarks*